US010099807B2

(12) United States Patent
Eisen et al.

(10) Patent No.: US 10,099,807 B2
(45) Date of Patent: Oct. 16, 2018

(54) REVERSIBLE BOX WITH TEAR-AWAY STRIPS

(71) Applicant: BIG BOY SCOTTY S, LLC, Chicago, IL (US)

(72) Inventors: Yale B. Eisen, Wilmette, IL (US); Troy L. Broetzman, North Aurora, IL (US); John B. Hill, Park Ridge, IL (US)

(73) Assignee: BIG BOY SCOTTY S, LLC, Chicago, IL (US)

( * ) Notice: Subject to any disclaimer, the term of this patent is extended or adjusted under 35 U.S.C. 154(b) by 140 days.

(21) Appl. No.: 14/930,262

(22) Filed: Nov. 2, 2015

(65) Prior Publication Data

US 2016/0122069 A1 May 5, 2016

Related U.S. Application Data

(60) Provisional application No. 62/073,601, filed on Oct. 31, 2014.

(51) Int. Cl.
*B65D 5/02* (2006.01)
*B65D 5/42* (2006.01)
(Continued)

(52) U.S. Cl.
CPC ..... *B65B 11/004* (2013.01); *B65D 5/2076* (2013.01); *B65D 5/4233* (2013.01); *B65D 5/547* (2013.01)

(58) Field of Classification Search
CPC ... B65B 11/004; B65D 5/2076; B65D 5/4233; B65D 5/547
(Continued)

(56) References Cited

U.S. PATENT DOCUMENTS 3,711,012 A * 1/1973 Cytron ..... B42D 15/08 229/306
4,210,250 A * 7/1980 Yale ..... B65D 27/04 229/303
(Continued)

FOREIGN PATENT DOCUMENTS

CN 201176319 Y 1/2009
DE 8529244 U1 12/1985
(Continued)

*Primary Examiner* — Chun Cheung
(74) *Attorney, Agent, or Firm* — Barnes & Thornburg LLP; Gregory H. Zayia

(57) ABSTRACT

A reversible paperboard container having a bottom panel, a front panel adjacent to and in foldable relationship with the bottom panel. A back panel is adjacent to and in foldable relationship with the bottom panel. A left side panel is adjacent to and in foldable relationship with the bottom panel, a right side panel is adjacent to and in foldable relationship with the bottom panel. A first top panel is adjacent to and in foldable relationship with the back panel, and a second top panel is adjacent to and in foldable relationship with the front panel. The first top panel includes a first adhesive strip to sealingly close the paperboard container into a closed configuration. A first tear-away strip is included on the first top panel to open the paperboard container from the closed configuration, and a second adhesive strip to sealingly close the paperboard container into a reversed, closed configuration. The second top panel includes a second tear-away strip to open the paperboard container from the reversed, closed configuration.

18 Claims, 11 Drawing Sheets

(51) Int. Cl.
*B65B 11/00* (2006.01)
*B65D 5/54* (2006.01)
*B65D 5/20* (2006.01)

(58) Field of Classification Search
USPC ..... 229/240, 227, 306, 924, 925, 926; 206/459.5
See application file for complete search history.

(56) References Cited

U.S. PATENT DOCUMENTS

| | | | | |
|---|---|---|---|---|
| 4,867,372 | A * | 9/1989 | Patterson | B65D 5/4233 206/459.5 |
| 4,917,287 | A * | 4/1990 | Watson | B65D 27/04 229/303 |
| 5,033,668 | A | 7/1991 | Cohen et al. | |
| 5,497,271 | A * | 3/1996 | Mulvanny | B60K 37/02 345/7 |
| 6,948,616 | B2 | 9/2005 | Gillani | |

FOREIGN PATENT DOCUMENTS

| | | |
|---|---|---|
| EP | 0997380 | 5/2000 |
| EP | 1348633 | 10/2003 |

* cited by examiner

REVERSIBLE BOX WITH TEAR-AWAY STRIPS

CROSS REFERENCE TO RELATED APPLICATIONS

This application claims the benefit of priority under 35 U.S.C. § 119(e) to U.S. Provisional Patent Application No. 62/073,601, filed Oct. 31, 2014. The disclosure set forth in the referenced application is incorporated herein by reference in its entirety.

BACKGROUND

Individuals often need to store products, transport products, or ship products from one location to another. A common approach for storing, transporting, or shipping products is to package the products in a paperboard container. However, existing paperboard containers present several drawbacks that make them more laborious and cumbersome to open, more laborious and cumbersome to close, and more wasteful and less conducive for reuse.

Accordingly, it would be desirable to develop improved configurations, systems, and methods for making and using paperboard containers. It would be desirable for the paperboard containers to be fabricated in a manner that promotes easy and efficient reuse of the box. It would also be desirable for the paperboard containers to be fabricated in a manner that facilitates efficient closing and efficient opening, both during initial use and during a reuse of the box.

This background information is provided to provide some information believed by the applicant to be of possible relevance to the present disclosure. No admission is intended, nor should such admission be inferred or construed, that any of the preceding information constitutes prior art against the present disclosure. Other aims, objects, advantages and features of the disclosure will become more apparent upon reading of the following non-restrictive description of specific embodiments thereof, given by way of example with reference to the accompanying drawings.

SUMMARY OF THE INVENTION

The present disclosure describes configurations, systems, and methods for making and using paperboard containers. Disclosed embodiments show paperboard containers having multiple panels along with associated flaps that are shaped, sized, and arranged according to particular configurations, dimensions, and aspect ratios. The panels and flaps are in foldable relationship with one another such that the paperboard container can be folded into a closed box form.

In illustrative embodiments, the paperboard container may be designed for easy and efficient reuse through reversibility, with an initial use in which the box is in a first orientation and a subsequent use in which the box is in a reversed orientation. The paperboard container may provide features that promote easy opening and closing during both the initial use and a subsequent reuse. Such features may include a first adhesive strip that promotes easy and efficient closure of the paperboard container during a first use, and a first tear-away strip that promotes easy and efficient opening of the paperboard container during the first use. Such features may also include a second adhesive strip that promotes easy and efficient closure of the paperboard container during a second use, and a second tear-away strip that promotes easy and efficient opening of the paperboard container during the second use. Illustratively, the first and second adhesive strips are both provided on a common side of an adhesive-carrying top panel, and the first tear-away strip is also provided on the adhesive-carrying top panel, while the second tear-away strip is provided on another top panel different from the adhesive-carrying top panel.

In other illustrative embodiments, the paperboard container does not include adhesive strips, but instead includes visual markings or indicia delineating where adhesive strips should be placed. A visual marking can be placed on the container in a first location delineating the appropriate placement of an adhesive strip during a first use of the container, and a visual marking can be placed in a second location on the container delineating the appropriate placement of an adhesive strip during a second use of the paperboard container. Alternatively, the paperboard container may be provided with one adhesive strip for an initial use of the paperboard container, but may include a visual marking delineating the appropriate placement of an adhesive strip for a second use of the paperboard container.

In other illustrative embodiments, a folding jig is provided to facilitate easy and efficient folding of panels and flaps in a desired manner.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

Figure 1:
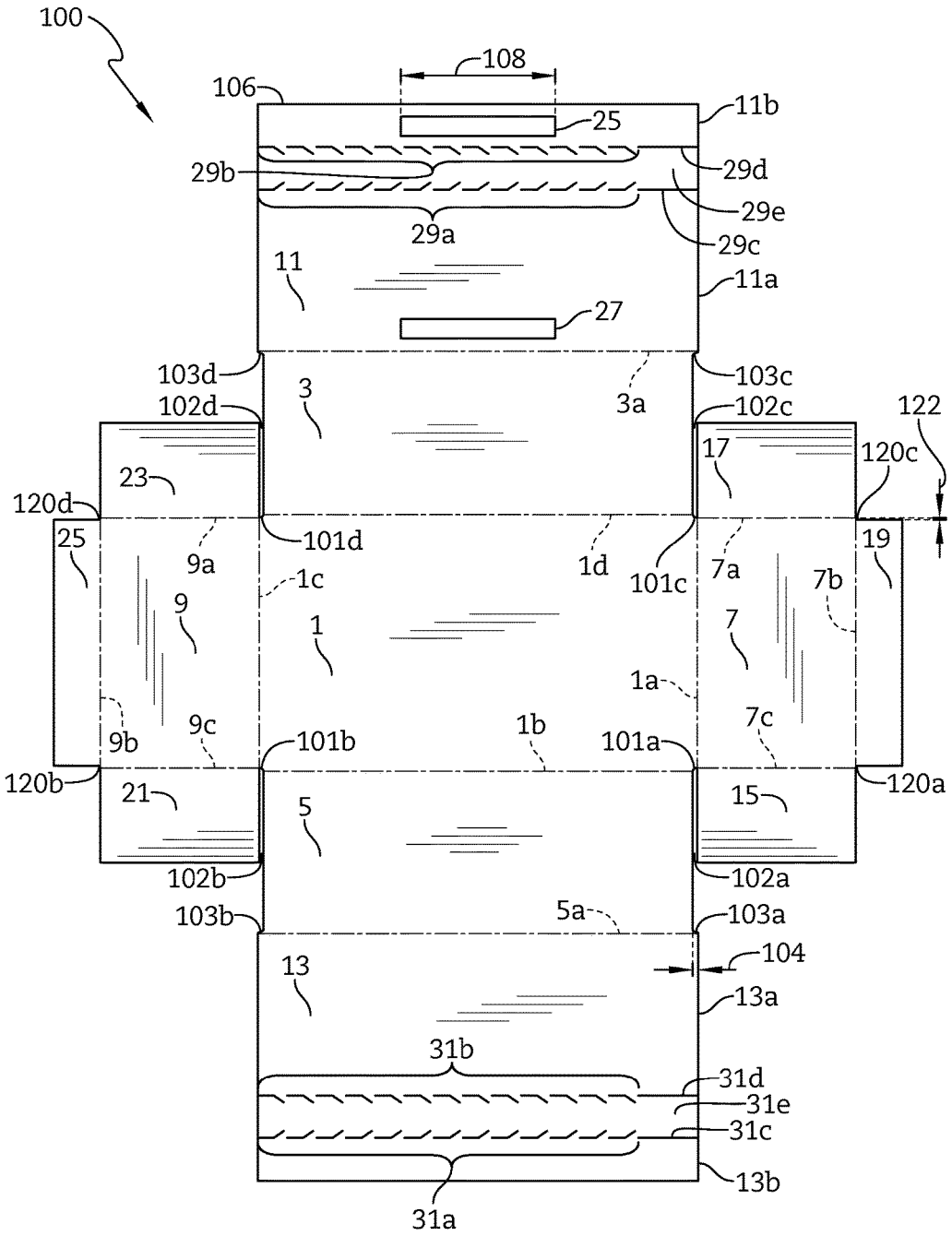
FIG. 1 is a plan view of a paperboard container in accordance with the present disclosure.

The exemplification set out herein illustrates embodiments of the disclosure that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION OF THE INVENTION

While the present disclosure may be susceptible to embodiment in different forms, there is shown in the drawings, and herein will be described in detail, embodiments with the understanding that the present description is to be considered an exemplification of the principles of the disclosure. The disclosure is not limited in its application to the details of structure, function, construction, or the arrangement of components (e.g., flaps, panels, etc.) set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of various phrases and terms is meant to encompass the items or functions identified and equivalents thereof as well as additional items or functions. Unless limited otherwise, various phrases, terms, and variations thereof herein are used broadly and encompass all variations of such phrases and terms. Furthermore, and as described in subsequent paragraphs, the specific configurations illustrated in the drawings are intended to exemplify embodiments of the disclosure. However, other alternative structures, dimensions, proportions, functions, and configurations are possible which are considered to be within the teachings of the present disclosure. Furthermore, unless otherwise indicated, the term "or" is to be considered inclusive.

Description will now be given with reference to the attached figures. It should be understood that these figures are exemplary in nature and in no way serve to limit the scope of the invention.

FIG. 1 is a plan view of a paperboard container 100 in accordance with the present disclosure. In this illustrative embodiment, paperboard container 100 is formed from one continuous sheet of paperboard in flat form that is subdivided or scored into several panels, flaps, and other features, as will be described in more detail below. However, paperboard container 100 could, in alternative embodiments, be made from multiple sheets of paperboard that are affixed together through adhesives, staples, or other binding mechanisms that are known in the art or hereafter developed. Moreover, paperboard container 100 may be formed of a corrugated material of known construction having two generally planar surfaces with a portion of corrugated material secured there between, the material is not limited to fabrication from a board material made of paper. The paperboard container 100 could be formed from any material suitable for box packaging, including composite materials, foam board, plastics, or any other material that is currently know or here after created that can be formed into sheet material for fabrication of the structures shown and described herein and can function in accordance with the teaching shown and described herein. The materials forming paperboard container 100 could be a variety of thicknesses, which may be determined by an application at hand—e.g., larger boxes designed to carry bulkier and/or heavier loads may require thicker paperboard materials.

The paperboard container 100 includes a bottom panel 1, a right side panel 7, a left side panel 9, a back panel 3, a front panel 5, a first, adhesive-carrying top panel 11, and a second top panel 13. The bottom panel 1 is adjacent to and in foldable relationship with right side panel 7, left side panel 9, back panel 3, and front panel 5. The back panel 3 is adjacent to and in foldable relationship with first, adhesive-carrying top panel 11. The front panel 5 is adjacent to and in foldable relationship with second top panel 13.

More particularly, bottom panel 1 is in foldable relationship with right side panel 7 through crease 1*a*, is in foldable relationship with front panel 5 through crease 1*b*, is in foldable relationship with left side panel 9 through crease 1*c*, and is in foldable relationship with back panel 3 through crease 1*d*. The back panel 3 is in foldable relationship with first, adhesive-carrying top panel 11 through crease 3*a*. The front panel 5 is adjacent to and in foldable relationship with second top panel 13 through crease 5*a*.

The bottom panel 1, right side panel 7, left side panel 9, back panel 3, and front panel 5 may be folded using the foldable relationships among these panels to form five of six faces of a box. When paperboard container 100 is folded into a closed box form, the outside surface of the bottom panel 1 will serve as the bottom face of the box, the outside surface of the right side panel 7 will serve as the right face of the box, the outside surface of the left side panel 9 will serve as the left face of the box, the outside surface of the front panel 5 will serve as the front face of the box, and the outside surface of the back panel 3 will serve as the back face of the box.

A sixth face of the box—the top face—is illustratively formed by a combination of first, adhesive carrying top panel 11 and second top panel 13. In a closed box configuration, first, adhesive carrying top panel 11 and second top panel 13 may partially or fully overlap with one another as to form the top face, as will be explained in more detail below.

It should be understood that the above-recited directional labels, and similar directional labels to be used below, simply establish a convention for narrative reference. For example, a user could signify that front panel 5 should serve as a back of a box (e.g., through markings on the box) should the user so desire.

In this illustrative embodiment, bottom panel 1, right side panel 7, left side panel 9, back panel 3, front panel 5, first, adhesive-carrying top panel 11, and second top panel 13 are generally rectangular. Their respective, generally rectangular shapes may, in varying embodiments, take on varying aspect ratios depending on the dimensional requirements for a desired box. In other embodiments, one or more of bottom panel 1, right side panel 7, left side panel 9, back panel 3, front panel 5, first, adhesive-carrying top panel 11, and second top panel 13 may be other shapes, such as trapezoidal. Generally, any suitable generally compatible geometric shapes can be used such that those shapes, when folded according to the above-described foldable relationships, may collectively form a closed-form box.

Although generally rectangular in shape, certain panels illustratively include additional structural features. For example, bottom panel 1 includes inwardly concave, rounded cuts 101*a-d*. The dimension of rounded cuts 101*a-d*, including length and radius of curvature, may be selected as to provide gaps 102*a-d* of a predetermined width between back panel 3 and flaps 17, 23 (to be discussed in more detail below), and between front panel 5 and flaps 15, 21 (to be discussed in more detail below). Illustratively, predetermined width of gaps 102*a-d* is approximately equal to the thickness of the paperboard material of which paperboard container 100 is fabricated, but other suitable widths may be selected.

Another such structural feature includes outwardly extending flares 103*a-d* extending from back panel 3 and front panel 5. The width 104 of flares 103*a-d* may be selected to be approximately equal to the thickness of the paperboard material of which the paperboard container 100 is fabricated, but other suitable widths may be selected.

The first, adhesive carrying top panel 11 includes features useful for easy and efficient opening and closing of paperboard container 100. Illustratively, first, adhesive carrying top panel 11 includes a first adhesive strip 25, a second adhesive strip 27, and a first tear-away strip 29. As will be explained in more detail below, first adhesive strip 25 is used to close the paperboard container 100 during a first use, while second adhesive strip 27 is used to close paperboard container 100 during a subsequent use. The first tear-away strip 29 is used to open paperboard container 100 during the first use, and a second tear-away strip 31 (on the second top panel 13, to be discussed below) is used to open paperboard container 100 during the subsequent use.

Figure 4:
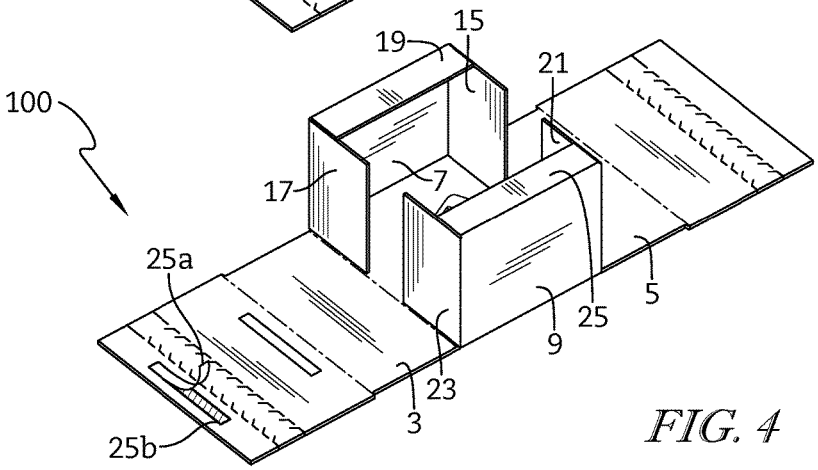
FIG. 4 is a perspective view of the paperboard container with side flaps folded inward, and with an adhesive strip backing partially removed as to expose an underlying adhesive material.
Figure 6:
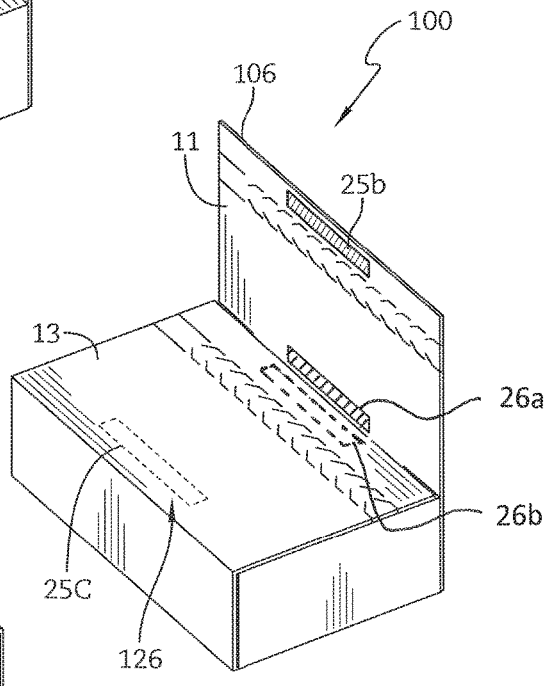
FIG. 6 is a perspective view of the paperboard container shown in FIG. 5 and rotated 180 degrees to show the adhesive strip on the corresponding second top panel, with a first top panel folded down, and showing a second, adhesive-carrying top panel approaching the first top panel in accordance with the present disclosure.

First adhesive strip 25 illustratively includes a protective, adhesive backing 25*a* and an adhesive material 25*b* disposed directly on a surface of paperboard container 100, as more clearly shown in FIG. 4. A second adhesive strip illustratively includes a protective, adhesive backing (analogous to the adhesive backing 25*a*) and an adhesive material 26*a* disposed directly on a surface of paperboard container 100, as shown in FIG. 6. The adhesive material 26*a* is configured for contacting a corresponding receiving adhesive strip—for example, a second receiving adhesive strip 26*b* as shown in FIG. 6. In use, a user may peel away adhesive backing 25*a* as to expose adhesive material 25*b*, such that the surface area covered by adhesive material 25*b* can adhere to another surface affixed thereto. Suitable materials for adhesive backing 25*a* and adhesive material 25*b* are generally known, and any such material can be used in connection with adhesive strip 25. For example, an adhesive material having double sided material could be used with one side being secured to the surface of the paperboard material with the removable backing covering the remaining adhesive side for use as described. The adhesive strip could also eliminate the backing by having a contact adhesive which is generally inert or non-adhesive relative to other surfaces but adhesive when it contacts another compatible material, such as an appropriately positioned corresponding receiving adhesive strip—for example, the receiving adhesive strip (25*c*) shown in FIG. 6—to which it may bond forming an adhesive connection.

Figure 7:
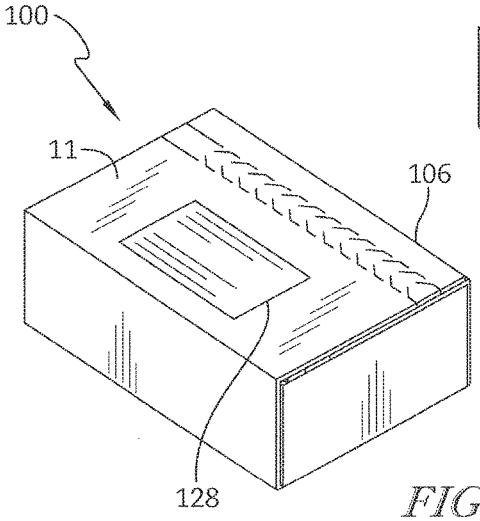
FIG. 7 is a perspective view of the paperboard container in a closed and sealed configuration in preparation for shipping in accordance with the present disclosure.

First adhesive strip 25 is located near a front edge 106 (i.e., an edge 106 that will be disposed towards a front of paperboard container 100 when placed in a closed configuration, as shown in FIG. 7). First adhesive strip 25 has a length 108 that spans a generally predetermined length, range of lengths, or distance alongside the length of front edge 106. In this illustrative embodiment, length 108 of adhesive strip 25 is about one-third the length of edge 106. Generally, however, any shape and dimension for adhesive strip 25 may be used such that adhesive material 25*b* covers sufficient surface area as to provide effective and durable adhesion while paperboard container 100 is in transit.

The second adhesive strip 27 is located near crease 3*a*, and in this illustrative embodiment is similarly shaped, sized, and manufactured as first adhesive strip 25.

Figure 8:
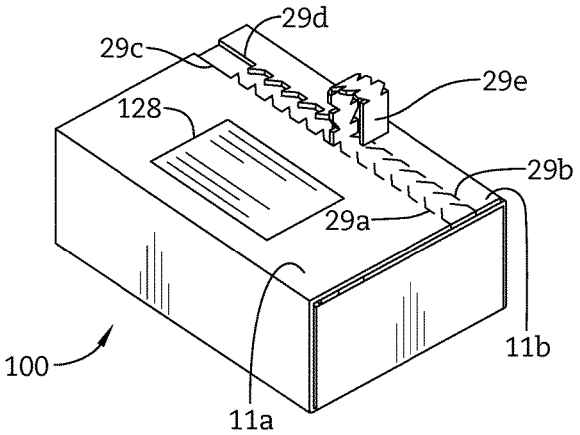
FIG. 8 is a perspective view of the paperboard with a first tear-away strip being torn off to open the paperboard container in accordance with the present disclosure.

The first tear-away strip 29 is configured to allow a user to tear open paperboard container 100 after it has been placed in a closed configuration, as shown in FIG. 8. Thus, first tear-away strip 29 is illustratively formed integrally as part of first, adhesive carrying top panel 11 through two perforated rows 29*a* and 29*b*. The tear-away strip 29 also includes two generally linear, parallel cuts 29*c* and 29*d* which provide a weakened area of the material and which together form a pullable tab 29*e*. As more clearly illustrated in FIG. 8, a user can pull upwards on pullable tab 29*e* to begin tearing of tear-away strip 29, and continue pulling on tab 29*e* to cause continued tearing along perforated rows 29*a* and 29*b*. The tear-away strip 29 is disposed between first adhesive strip 25 and second adhesive strip 27, and in this example is disposed closer to first adhesive strip 25 than second adhesive strip 27. While the tear-away strip is shown as a portion of the material that has been formed with perforated rows and cuts providing a pullable tab, the tearable strip may be configured of any type of arrangement of materials and/or cuts or other weakening of material that can help cut, rip, detach or otherwise separate two adjoining portions of the material for facilitating opening of the container, which arrangement is currently known or hereafter developed and compatible with the teachings of this disclosure.

Figure 14:
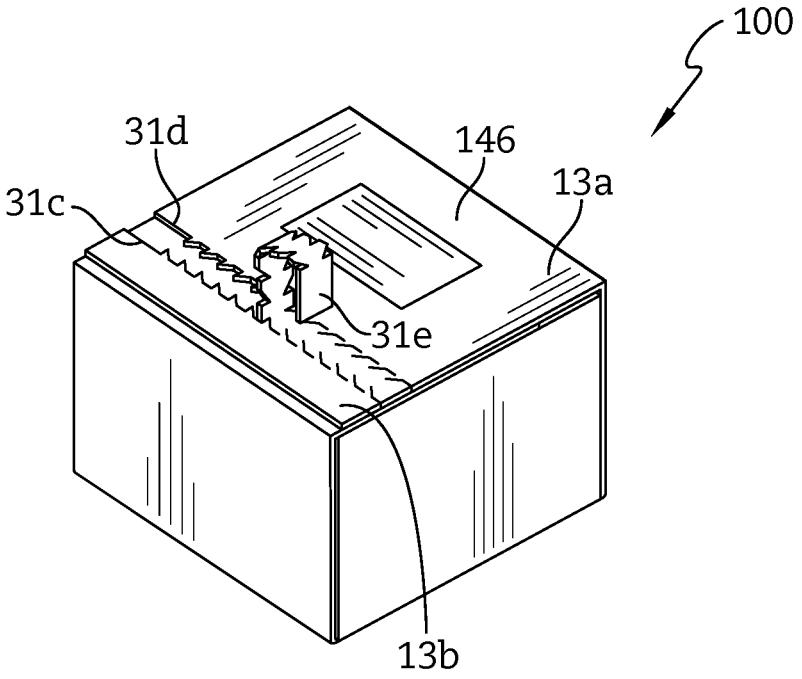
FIG. 14 is a perspective view of the paperboard container in the reversed orientation during the subsequent use, in which a second tear-away strip is being removed to open the paperboard container a second time in accordance with the present disclosure.

Second top panel 13 includes a second tear-away strip 31 similarly sized, shaped, and configured as first tear-away strip 29. Thus, second tear-away strip 31 includes two generally linear, parallel series of perforations or perforated rows 31*a* and 31*b* which provide a weakened area of the material and which together form the corresponding tear-away strip, and two cuts 31*c* and 31*d* that form a pullable tab 31*e*. FIG. 14, which will be described in more detail below, shows the use of second tear-away strip 31 in opening paperboard container 100 during a subsequent use.

Figure 5:
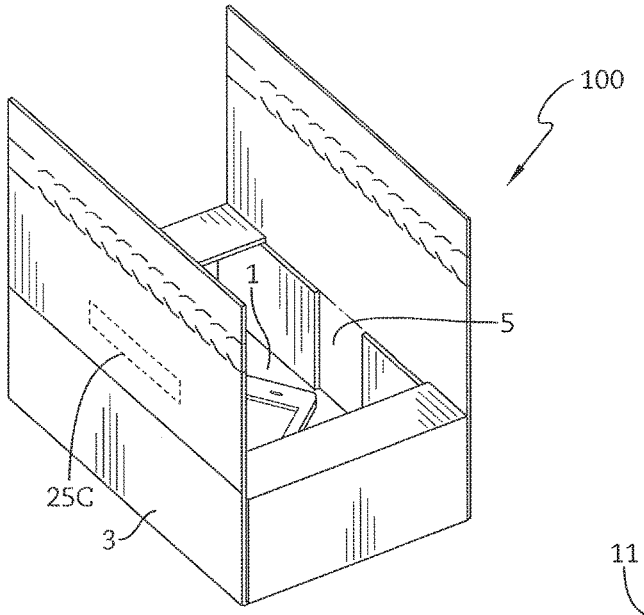
FIG. 5 is a perspective view of the paperboard container with front and back panels folded upright in accordance with the present disclosure.

In addition to the panels and panel features described above, the paperboard container 100 also includes flaps adjoined to right side panel 7 and left side panel 9. These flaps may be configured to add to the structural integrity of paperboard container 100 when in a closed configuration. The flaps can also be configured to maintain a predetermined position or condition in the closed state as illustrated in FIGS. 5-7 without the use of internal or external adhesive tape, stapling, gluing, or other fasteners. Illustratively, paperboard container 100 includes a right side back flap 17 that is in foldable relationship with right side panel 7 through crease 7*a*, a right side top flap 19 that is in foldable relationship with right side panel 7 through crease 7*b*, and a right side front flap 15 that is in foldable relationship with right side panel 7 through crease 7*c*. The paperboard container 100 also includes a left side back flap 23 that is in foldable relationship with left side panel 9 through crease 9*a*, a left side top flap 25 that is in foldable relationship with left side panel 9 through crease 9*b*, and a left side front flap 21 that is in foldable relationship with left side panel 9 through crease 9*c*.

The flaps 15, 17, 19, 21, 23, and 25 are generally rectangular, and may, in varying embodiments, take on varying aspect ratios depending on the dimensional requirements for a desired box. Although generally rectangular in shape, in this illustrative embodiment certain flaps include additional structural features. For example, right side top flap 19 and left side top flap 25 include rounded flares 120*a-d*. The dimensions, including width and radius of curvature of rounded flares 120*a-d*, may vary. In this illustrative embodiment, width 122 of rounded flares 120*a-d* is approximately equal to the thickness of the paperboard material of which paperboard container 100 is fabricated.

Figure 2:
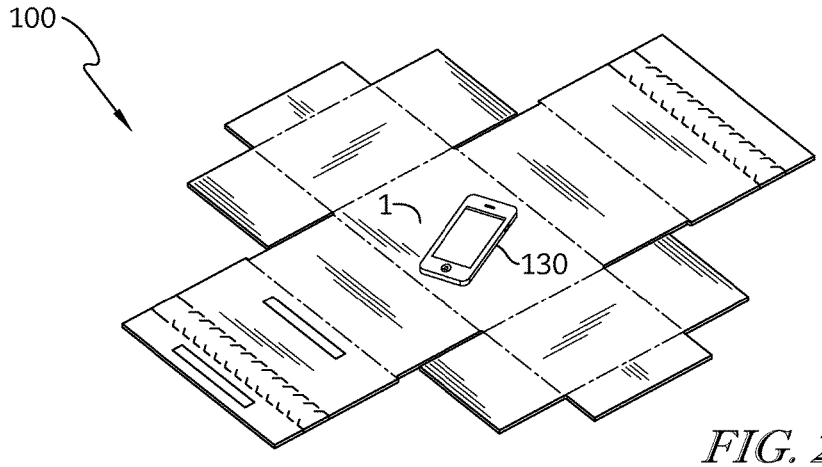
FIG. 2 is a perspective view of the paperboard container in an open configuration oriented for a first use in accordance with the present disclosure.
Figure 3:
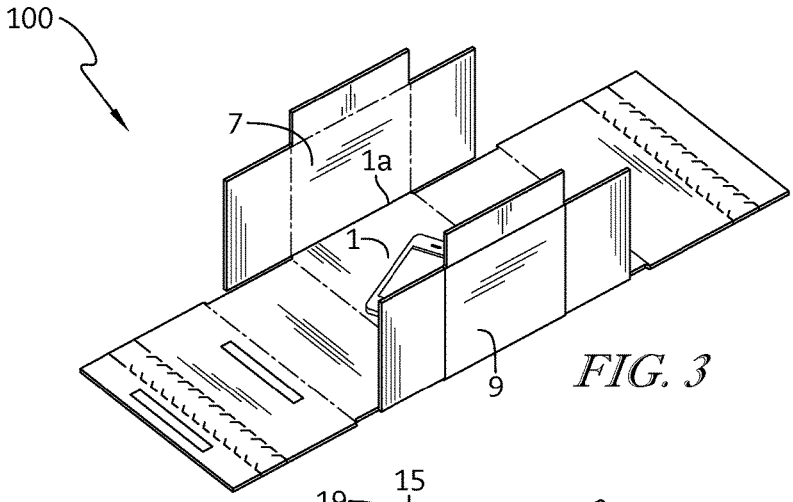
FIG. 3 is a perspective view of the paperboard container with left and right side panels folded upright in accordance with the present disclosure.

FIGS. 2-7 illustrate an exemplary methodology for closing paperboard container 100. FIG. 2 is a perspective view of paperboard container 100 in an open configuration, in which a user has placed an object 130 onto bottom panel 1, ready for storage or shipping. As shown in FIG. 3, the user may begin closing paperboard container 100 by folding left side panel 9 vertically upwards about crease 1*c*, and by folding right side panel 7 vertically upwards about crease 1*a*. Left side panel 9 and right side panel 7 will then be disposed generally orthogonal to bottom panel 1.

As shown in FIG. 4, the user may next fold right side top flap 19 and left side top flap 25 downwards, such that right side top flap 19 and left side top flap 25 assume horizontal dispositions and extend towards one another. The user may also fold right side back flap 17 and left side back flap 23 inwards, such that they extend towards one another, and similarly fold right side front flap 15 and left side front flap 21 inwards, such that they extend towards one another. Right side top flap 19, right side back flap 17, and right side front flap 15 will then be disposed generally orthogonal to right side panel 7, and left side top flap 25, left side back flap 23, and left side front flap 21 will then be disposed generally orthogonal to left side panel 9.

FIG. 4 also shows that a user may remove adhesive backing 25*a* as to expose adhesive material 25*b*, in preparation for sealing paperboard container 100, as will be shown below. The adhesive backing 25*a* can then be discarded.

FIG. 5 shows that the user may next fold back panel 3 and front panel 5 vertically upwards about creases 1*d* and 1*b*, respectively. Back panel 3 and front panel 5 will then be disposed generally orthogonal to bottom panel 1.

FIG. 6 shows that the user may next fold down second top panel 13 about crease 5*a* as to be disposed horizontally and orthogonal top front panel 5. The user may also draw downwards first, adhesive carrying top panel 11 about crease 3*a*. In doing so, the user may draw exposed adhesive material 25*b* towards a target location 126 that will affix to adhesive material 25*b*.

FIG. 7 shows that the user may fully draw down first, adhesive carrying top panel 11, putting exposed adhesive material 25*b* in contact with target location 126 on second top panel 13. The user may, optionally, apply pressure to first, adhesive carrying top panel 11 to ensure a proper seal has been formed between exposed adhesive material 25*b* and target location 126. An address label 128 or other markings or indicia can be affixed to paperboard container 100, which can then be shipped to a recipient.

Figure 9:
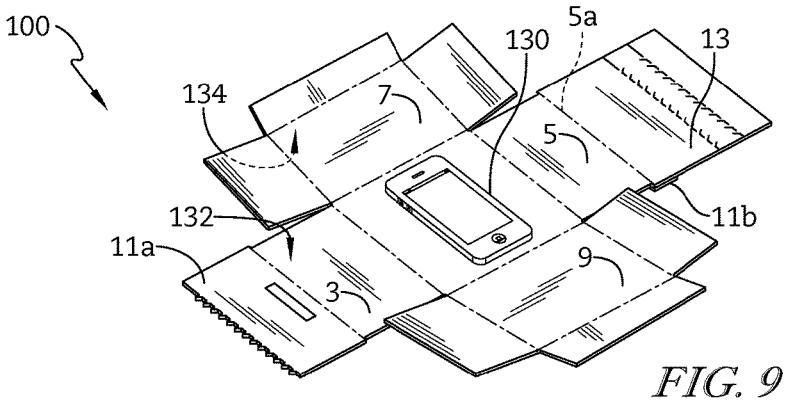
FIG. 9 is a perspective view of the paperboard container in an opened and substantially flat configuration for access to the item contained inside the container, after a recipient has opened the paperboard container in accordance with the present disclosure.

FIGS. 8-9 show how paperboard container 100 may be opened. FIG. 8 shows that a user has pulled tab 29*e*, causing tears along perforated rows 29*a* and 29*b*. After continuing to pull tab 29*e*, tear-away strip 29 will disengage from first, adhesive carrying top panel 11, which decouples a sealed portion 11*b* of first, adhesive carrying top panel 11 from an unsealed portion 11*a* of first, adhesive carrying top panel 11.

The decoupling of sealed portion 11*b* from unsealed portion 11*a* causes paperboard container 100 to open, as shown in FIG. 9. In illustrative embodiments, the decoupling causes paperboard container 100 to open into a generally flat orientation exposing shipped goods 130, as also shown in FIG. 9. While packaging materials such as cushioning, padding, or other packaging is not shown in the figures, such material could be used, but is not shown for ease of illustrating the structures of the container 100. The sealed portion 11*b* remains affixed to second top panel 13 adjacent to crease 5*a*.

That the box opens or collapses into a flat orientation is useful to a user because the user can reach laterally towards goods 130. With alternative, conventional paperboard containers, a user may open a top panel of the box, but the sides of the box would not collapse. The user would then have to reach over the sides and into the box in order to reach desired goods, and then pull the desired goods vertically out of the box. This is laborious, time consuming, and can cause physical pain. In the embodiment depicted in FIG. 9, a user can reach laterally towards goods 130 without being impeded by any panels.

Figure 10:
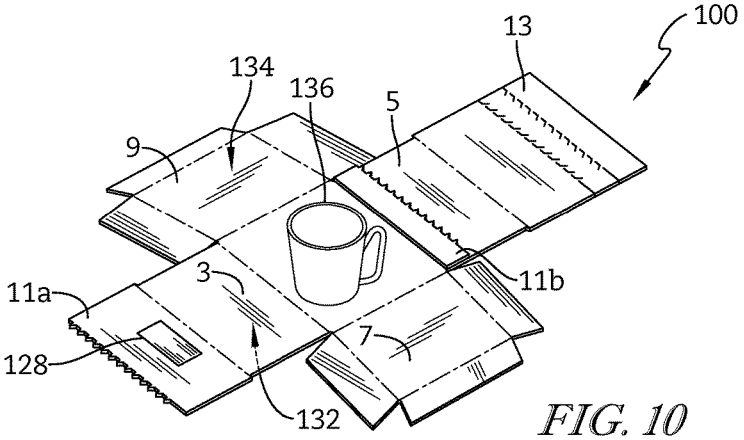
FIG. 10 is a perspective view of the paperboard container in a reversed, open orientation in which the container has been flipped to permit the former outside surface of the container to be used as the inside surface of the reused container, in preparation for a subsequent reuse of the paperboard container.

FIGS. 10-14 show how paperboard container 100 can be reused a subsequent time, such as by the recipient of goods 130. FIG. 10 shows that the recipient has flipped paperboard container 100 from the orientation depicted in FIG. 9 to a reverse orientation shown in FIG. 10. Thus, a first side 132 of paperboard container 100 that was previously upwards facing has been flipped over to be downwards facing. The first side 132 had been an interior surface of paperboard container 100 during the first usage as depicted in FIGS. 2-9, and will serve as an exterior surface during the subsequent usage.

Meanwhile, a second side 134 that had served as an exterior surface of paperboard container 100 during the first usage will serve as the interior surface during the subsequent usage. This provides the benefit that address label 128 or any other markings or indicia that had been placed on side 134 while it served as an exterior surface will be positioned, during the subsequent usage, on an interior surface and therefore not be externally visible when the paperboard container 100 assumes a closed configuration during the subsequent usage. This frees the first side 132, which will serve as an exterior surface during the subsequent usage, from distracting labels, markings, or indicia that were relevant to the first usage but not relevant to the subsequent usage, and allows the recipient to place new labels, markings, and indicia onto side 132 that are relevant to the subsequent usage.

FIG. 10 shows that the recipient, after having flipped paperboard container 100 into a reverse orientation, may place goods 136 that will be shipped during the subsequent usage onto bottom panel 1.

Figure 11:
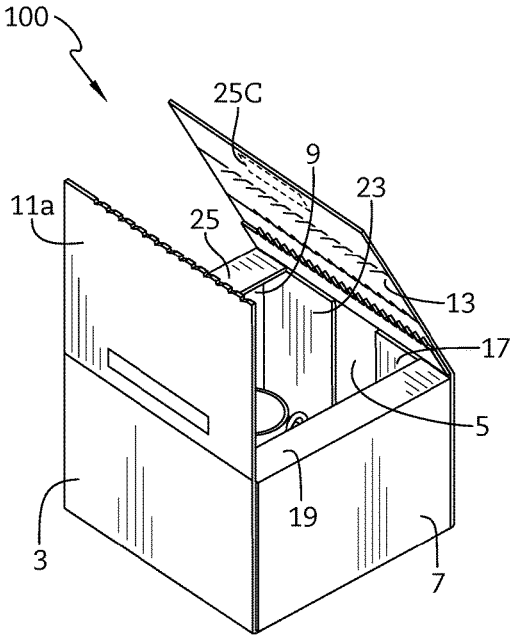
FIG. 11 is a perspective view of the paperboard container in the reversed orientation during the subsequent reuse, in which the left side panel, the right side panel, the front panel, and the back panel have been folded upright in preparation for closing and sealing the paperboard container in accordance with the present disclosure.

FIG. 11 shows that the recipient may next fold left side panel 9 vertically upwards about crease 1*c*, and fold right side panel 7 vertically upwards about crease 1*a*. Left side panel 9 and right side panel 7 will then be disposed generally orthogonal to bottom panel 1. The user may next fold right side top flap 19 and left side top flap 25 downwards, such that right side top flap 19 and left side top flap 25 assume horizontal dispositions and extend towards one another. The user may also fold right side back flap 17 and left side back flap 23 inwards, such that they extend towards one another, and similarly fold right side front flap 15 and left side front flap 21 inwards, such that they extend towards one another. Right side top flap 19, right side back flap 17, and right side front flap 15 will then be disposed generally orthogonal to right side panel 7, and left side top flap 25, left side back flap 23, and left side front flap 21 will then be disposed generally orthogonal to left side panel 9. Next, the user may fold back panel 3 and front panel 5 vertically upwards about creases 1*d* and 1*b*, respectively. Back panel 3 and front panel 5 will then be disposed generally orthogonal to bottom panel 1.

Figure 12:
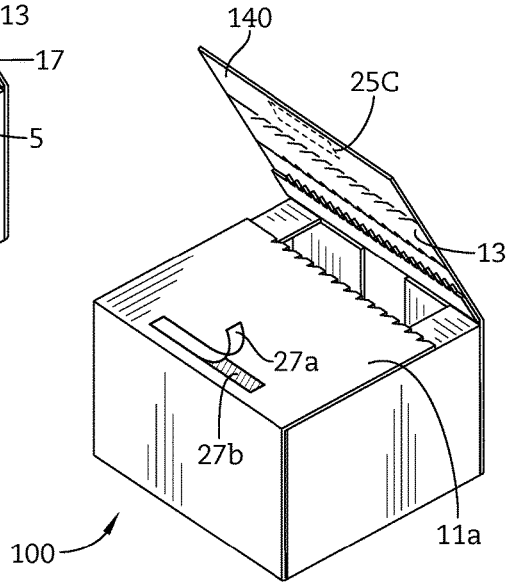
FIG. 12 is a perspective view of the paperboard container in the reversed orientation during the subsequent reuse, in which an adhesive-carrying top panel has been folded down, and showing that an adhesive strip backing of a second adhesive strip has been partially removed as to expose underlying adhesive material in accordance with the present disclosure.

As shown in FIG. 12, the recipient may then fold down unsealed portion 11*a* of first, adhesive carrying top panel 11 down, as to assume a generally horizontal orientation. The user may then remove adhesive backing 27*a* as to expose adhesive material 27*b*, in preparation for sealing paperboard container 100, as will be shown below. The adhesive backing 27*a* can then be discarded.

The user may then draw second top panel 13 downwards towards unsealed portion 11*a* of first, adhesive carrying top panel 11, thus drawing a target location 140 towards exposed adhesive material 27*b*.

Figure 13:
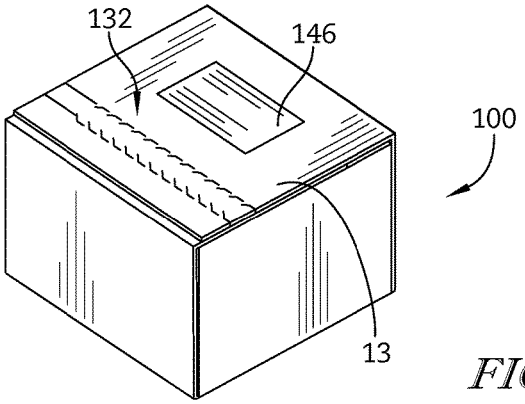
FIG. 13 is a perspective view of the paperboard container in the reversed orientation during the subsequent reuse, in which the paperboard container has been closed and sealed in preparation for a subsequent delivery in accordance with the present disclosure.

FIG. 13 shows that the recipient may fully draw down second top panel 13, putting target location 140 in contact with exposed adhesive material 27*b*. The user may, optionally, apply pressure to second top panel 13 to ensure a proper seal has been formed between exposed adhesive material 27*b* and target location 140. As shown, side 132 of paperboard container 100 now forms the exterior surface of paperboard container 100, which is free of distracting address labels, markings or indicia from the prior usage of paperboard container 100, and allows the user to place a new address label 146 on paperboard container 100.

FIG. 14 shows that a subsequent recipient of paperboard container 100, upon receipt of paperboard container 100, may open paperboard container 100 by pulling on tab 31*e*. This causes tear-away strip 131 to decouple an unsealed portion 13*a* of second top panel 13 from a sealed portion 13*b* of second top panel 13. The sealed portion 13*b* remains affixed to exposed adhesive material 127*b* on top panel portion 11*a*.

The decoupling of sealed portion 13*b* from unsealed portion 13*a* causes paperboard container 100 to open. In illustrative embodiments, the decoupling causes the paperboard container 100 to open to a generally flat orientation, which is beneficial for the reasons explained above.

Figure 15A:
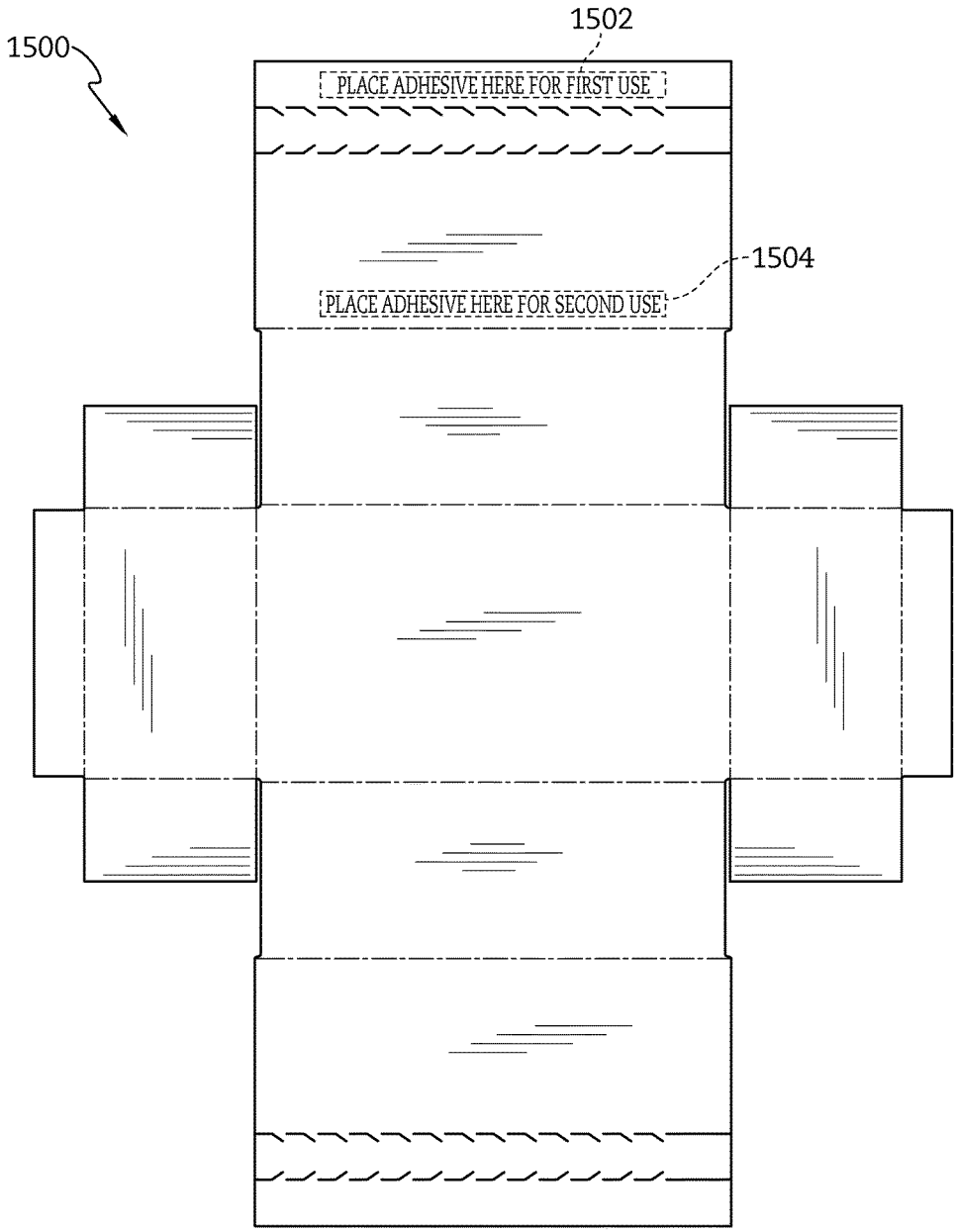
FIG. 15A is an alternate embodiment of the paperboard container depicted in FIG. 1, in which the paperboard container includes visual markings indicating where a first adhesive strip can be placed for a first use of the container and where a second adhesive strip can be placed for a second use of the container.
Figure 15B:
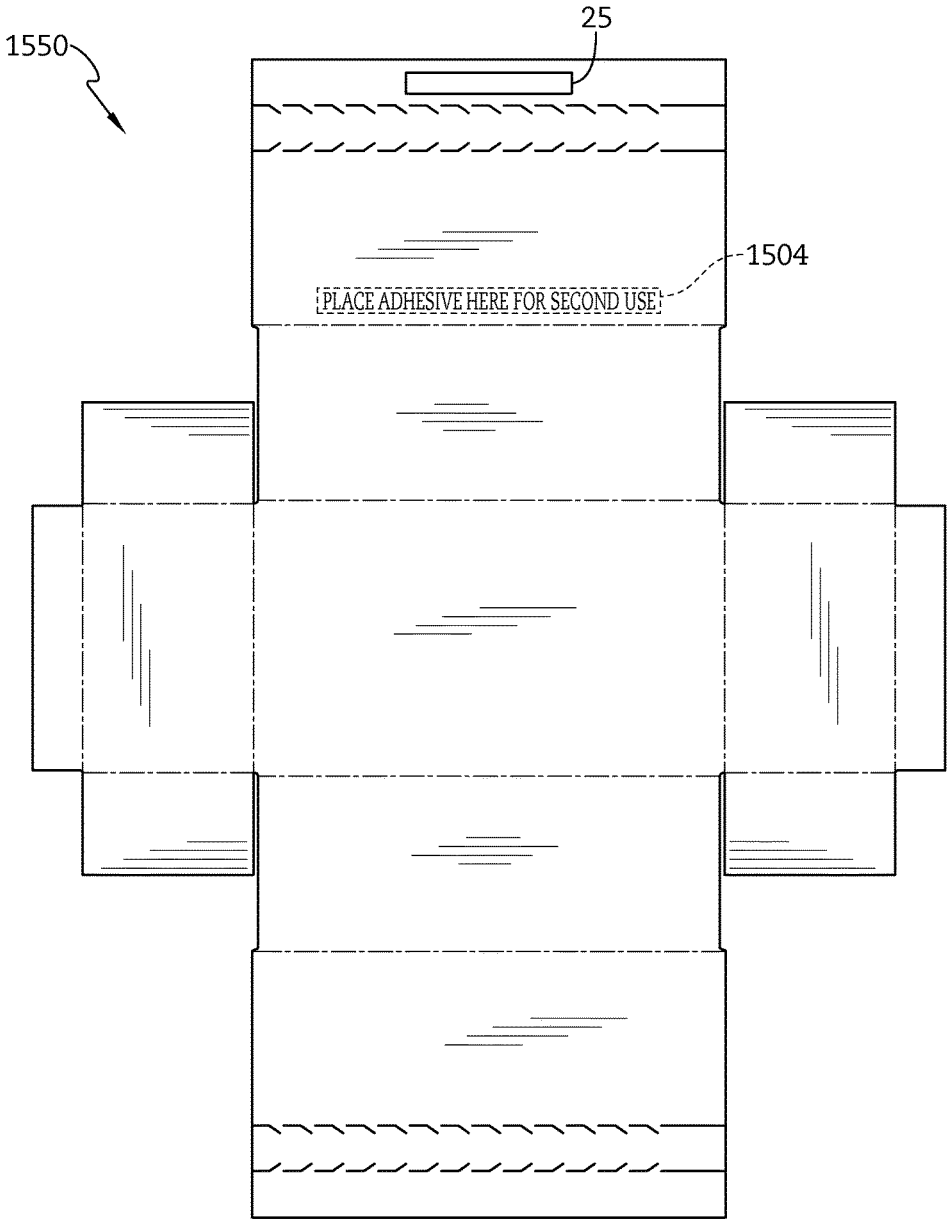
FIG. 15B is an alternate embodiment of the paperboard container depicted in FIG. 1, in which the paperboard container includes one adhesive strip for use during a first usage of the paperboard container, and a visual marking at a second location indicating where an adhesive strip may be placed during a subsequent use of the container.

FIGS. 15A-B show alternative embodiments of a paperboard container in accordance with the present disclosure that do not include one or both of first adhesive strip 25 and second adhesive strip 27. Providing first adhesive strip 25 and second adhesive strip 27 on paperboard container 100 may be beneficial in that both the first user and the second user of paperboard container 100 can easily seal paperboard container 100. As explained above, the first user can simply remove adhesive backing 25*a* in order to expose adhesive material 25*b*, and the second user can simply remove adhesive backing 27*a* in order to expose adhesive material 27*b*. This provides both the first and second user with ready access to adhesive materials used for sealing paperboard container 100.

However, adhesive strips 25 and 27 may add to the cost of production for paperboard container 100, and some consumers may not want to pay for this additional cost. For example, some consumers may not care to seal paperboard container 100 or may have their own preferred mechanisms for sealing paperboard container 100. Such consumers may not want to incur the additional cost associated with adhesive strips 25 and 27.

Other consumers may desire first adhesive strip 25, but may be less interested in second adhesive strip 27. Such a consumer may seek a paperboard container having first adhesive strip 25 so that the consumer has ready access to a sealing mechanism during that consumer's initial usage of paperboard container 100. But the consumer may not want to pay for second adhesive strip 27, which may be used—if at all—by someone else, such as the recipient of paperboard container 100.

Accordingly, FIG. 15A shows an embodiment of a paperboard container 1500 that includes neither adhesive strip 25 nor adhesive strip 27, while FIG. 15B shows an embodiment of a paperboard container 1550 that includes adhesive strip 25 but does not include adhesive strip 27.

Turning first to FIG. 15A, paperboard container 1500, illustratively, is the same as paperboard container 100 discussed above, but does not include first adhesive strip 25 or second adhesive strip 27. Instead, paperboard container includes a first visual marking 1502 at a location that was occupied by first adhesive strip 25 in connection with paperboard container 100, and a second visual marking 1504 at a location that was occupied by second adhesive strip 27 in connection with paperboard container 100. Each of visual markings 1502, 1504 indicate to a user where the user can place adhesive material to close and seal paperboard container 1500.

The first visual marking 1502 may, illustratively, read "PLACE ADHESIVE HERE FOR FIRST USE." This indicates to a first user of paperboard container 1500 the location where adhesive material should be placed during a first use of paperboard container 1500. The user may place an adhesive material at the location of visual marking 1502, such as double-sided tape, glue, etc. The user may then close paperboard container 1500 in like fashion as what was described for paperboard container 100 in connection with FIGS. 2-7, above.

After the recipient opens paperboard container 1500 and wishes to reuse it, the recipient may observe second visual marking 1504, which illustratively reads "PLACE ADHESIVE HERE FOR SECOND USE." This indicates to the recipient where adhesive material should be placed during the subsequent of paperboard container 1500. The user may place an adhesive material at the location of visual marking 1504, such as double-sided tape, glue, etc. The user may then close paperboard container 1500 in like fashion as what was described for paperboard container 100 in connection with FIGS. 10-13, above.

FIG. 15B shows an embodiment of a paperboard container 1550 that includes first adhesive strip 25, but does not include second adhesive strip 27. In place of second adhesive strip 27, paperboard container includes visual marking 1504 described above, which illustratively reads "PLACE ADHESIVE HERE FOR SECOND USE." A first user of paperboard container 1550 may close paperboard container 1550 for shipment according to the methodology discussed above for paperboard container 100 in connection with FIGS. 2-7. The second user of paperboard container 1550 may then observe second visual marking 1504, and place an adhesive material at the location of visual marking 1504, such as double-sided tape, glue, etc. The user may then close paperboard container 1550 in like fashion as what was described for paperboard container 100 in connection with FIGS. 10-13, above.

Figure 16:
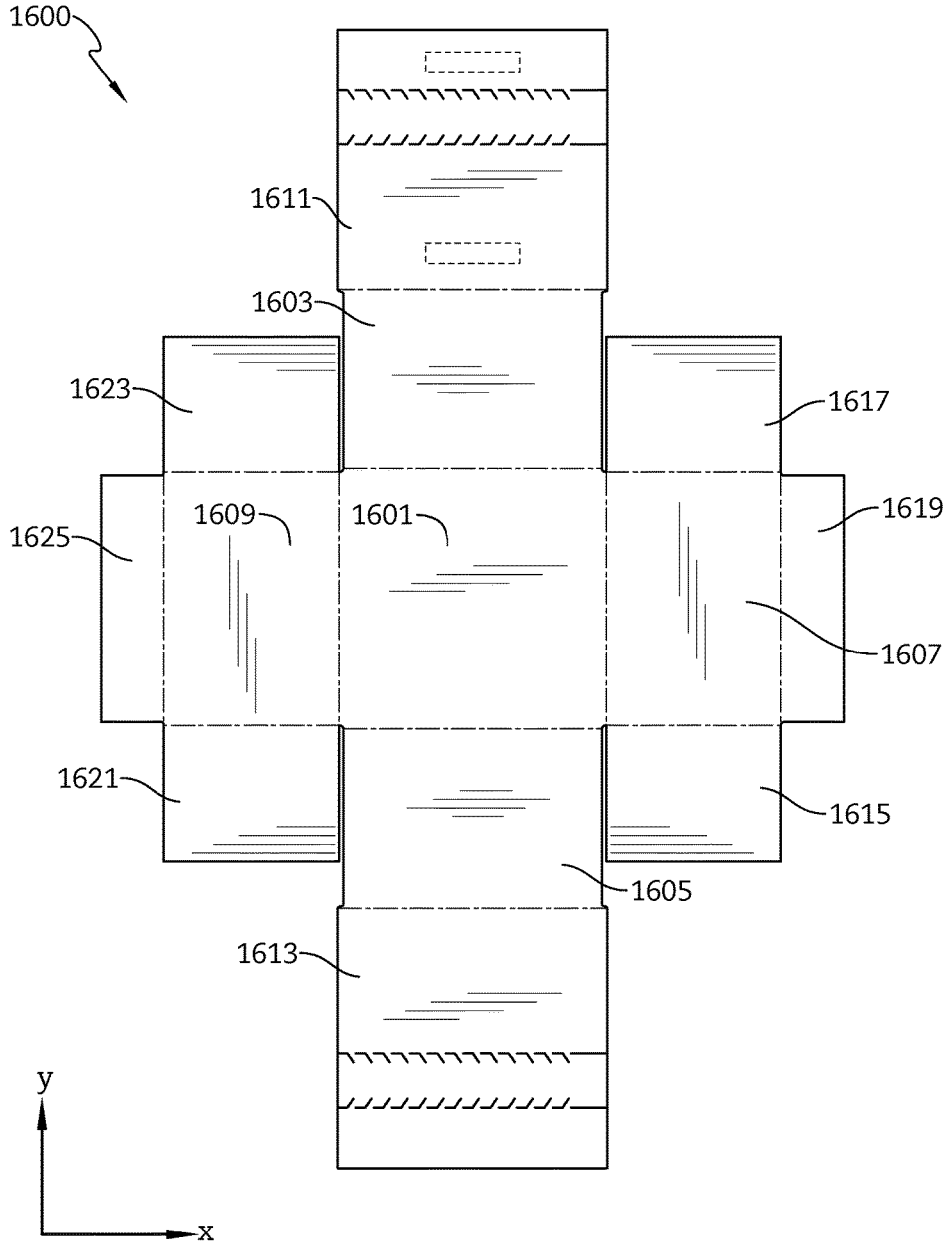
FIG. 16 is a plan view of an alternative embodiment of a paperboard container having different dimensions as compared to the paperboard container depicted in FIG. 1.

FIG. 16 shows a paperboard container 1600 having panels and flaps with alternative dimensions to that of paperboard container 100. The paperboard container 1600 has a bottom panel 1601, a back panel 1603, a front panel 1605, a first, adhesive-carrying top panel 1611, and a second top panel 1613 that are shorter in the x dimension and longer in the y dimension as compared to corresponding panels of paperboard container 100. The paperboard container 1600 has a right side panel 1607 and a left side panel 1609 that are longer in the x dimension as compared to corresponding panels of paperboard container 100. The paperboard container 1600 has a right side back flap 1617, a right side front flap 1615, a left side back flap 1623, and a left side front flap 1621 that are longer in the y dimension as compared to corresponding flaps of paperboard container 100. The paperboard container 1600 has a right side top flap 1619 and a left side top flap 1625 that are longer in the x dimension as compared to corresponding flaps of paperboard container 100.

Figure 17:
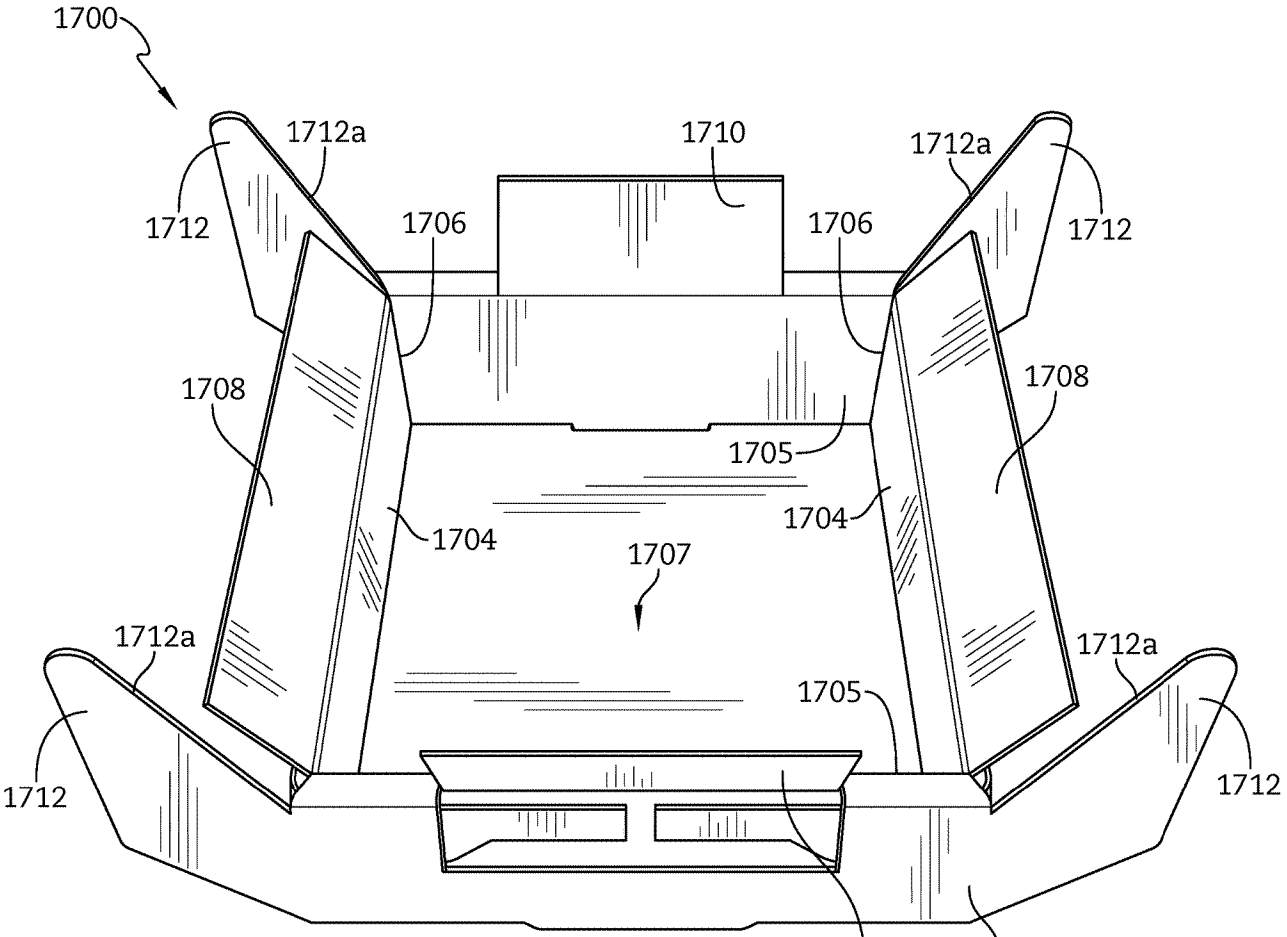
FIG. 17 is a perspective view of a jig that can be used to receive and facilitate controlled and orderly closure of the paperboard container depicted in FIG. 1.

FIG. 17 shows a folding jig 1700 that facilitates easy and efficient folding of paperboard container 100 in accordance with the present disclosure. The folding jig 1700 can be made of any material having sufficient structural integrity, such as cardboard, plastics, or wood.

The folding jig 1700 has a generally rectangular base 1707. The rectangular base 1707 is terminated by four faces—two front and back folding faces 1704 and two side folding faces 1705. The front and back folding faces 1704 meet side folding faces 1705 at edges 1706, two of which are depicted in FIG. 17 and two of which are obscured from view. The two front and back folding faces 1704 and two side folding faces 1705 generally form a negative space rectangular prism, whose dimensions may vary based on the dimensions of the paperboard container 100 being folded.

The front and back folding faces 1704 and two side folding faces 1705 extend upwards vertically or near-vertically. In this illustrative embodiment, front and back folding faces 1704 and two side folding faces 1705 are slightly inclined outwardly away from a vertical orientation.

The front and back folding faces 1704 extend upwards to meet front and back folding ramps 1708. The front and back folding ramps 1708 are further inclined away from a vertical orientation than front and back folding faces 1704, as to provide an outward flare extending away from rectangular base 1707. Similarly, two side folding faces 1705 extend upwards to meet side folding ramps 1710. The side folding ramps 1710 are further inclined away from a vertical orientation than side folding faces 1705, as to provide an outward flare extending away from rectangular base 1707.

Extending outwards from an exterior surface 1705*a* of side folding faces 1705 are winged flap folding extensions 1712. The winged flap folding extensions 1712 include inward-facing, inclined edges 1712*a*.

Figure 18:
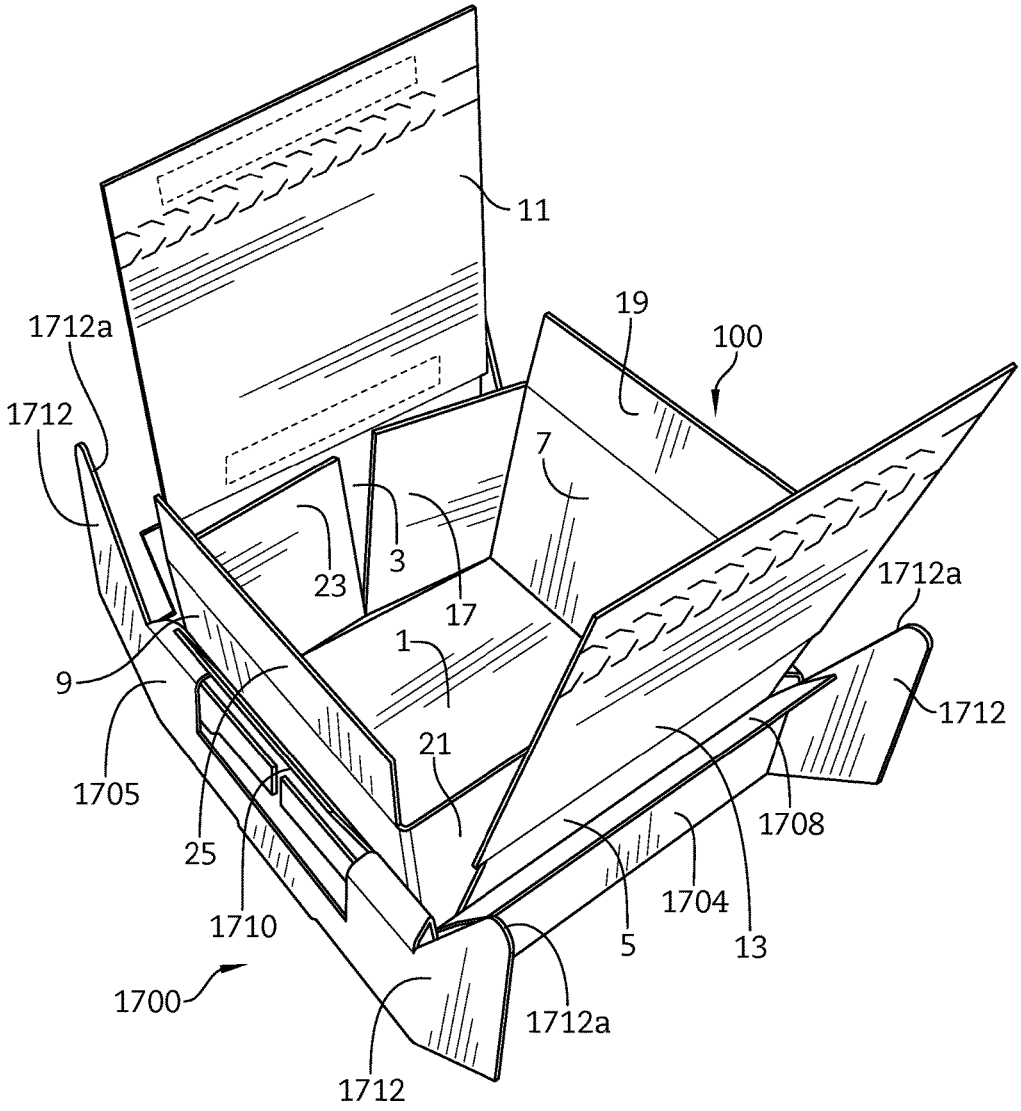
FIG. 18 is a perspective view of the paperboard container of FIG. 1 that has been partially folded through use of the jig depicted in FIG. 17.

FIG. 18 shows a paperboard container that has been partially folded through use of jig 1700 depicted in FIG. 17. In one exemplary use of folding jig 1700, the user aligns paperboard container 100, in the open configuration as shown in FIG. 1, vertically above folding jig 1700 such that bottom panel 1 is roughly parallel to rectangular base 1707 and contained within the vertical footprint of rectangular base 1707. The user aligns left side panel 9 and right side panel 7 over respective side folding ramps 1710, aligns front panel 5 and back panel 3 over respective front and back folding ramps 1708, and aligns right side front flap 15, right side back flap 17, left side front flap 21, and left side back flap 23 over winged flap folding extensions 1712.

Next, the user, either directly or using a machine, applies a force normal to the plane of paperboard container 100 (e.g., normal to bottom panel 1 and rectangular base 1707). Upon application of such a normal-force, several actions lead to the partial folding of paperboard container 100, though not necessarily in the order described. First, inward-facing, inclined edges 1712*a* of winged flap folding extensions 1712 make contact with right side front flap 15, right side back flap 17, left side front flap 21, and left side back flap 23, causing them to fold inwards about creases 7*a*, 7*c*, 9*a*, and 9*c*, respectively. Second, side folding ramps 1710 make contact with left side panel 9 and right side panel 7, causing them to fold inwards about creases 1*a* and 1*c*, respectively. Third, front and back folding ramps 1708 make contact with front panel 5 and back panel 3, causing them to fold inwards about creases 1*b* and 1*d*, respectively. As the user continues pressing down on bottom panel 1, the above-described folding actions continue until paperboard container 100 assumes the partially folded configuration shown in FIG. 18.

As shown, use of folding jig 1700 saves a user several folding steps. The user may complete any remaining folding, closing, and sealing operations in the manner depicted above in connection with FIGS. 2-7.

The folding jig 1700 may also be used during a second use of paperboard container 100 when in the reverse orientation, in similar fashion as what was described above, except that the user will place paperboard container 100 over folding jig 1700 in a flipped orientation, such that side 134 faces upwards and side 132 faces downwards towards rectangular base 1707.

Thus, as explained, the present disclosure describes configurations, systems, and methods that address technical problems associated with making and using paperboard containers. It will be appreciated that still further embodiments of the present invention will be apparent to those skilled in the art in view of the present disclosure. It is to be understood that the present invention is by no means limited to the particular constructions herein disclosed and/or shown in the drawings, but also comprises any modifications or equivalents within the scope of the invention. Examples in particular include but are not limited to, changing the final aspect ratio of the folded box, utilizing different grades of paperboard, flute size, or otherwise different foldable materials. Furthermore it shall be appreciated that different types or classes of adhesives could be used; pressure sensitive adhesive, hot-melt, or any other type of glue/adhesive would suffice. Even a strip of tape could be used to join the surfaces appropriately.

While the present disclosure describes various exemplary embodiments, the disclosure is not so limited. To the contrary, the disclosure is intended to cover various modifications, uses, adaptations, and equivalent arrangements based on the principles disclosed. Further, this application is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims. The scope of the following claims is to be accorded the broadest interpretation so as to encompass all such modifications and equivalent structures and functions.

The invention claimed is:

1. A reversible paperboard container, comprising:

a bottom panel;

a front panel adjacent to and in foldable relationship with the bottom panel;

a back panel adjacent to and in foldable relationship with the bottom panel;

a left side panel adjacent to and in foldable relationship with the bottom panel;

a right side panel adjacent to and in foldable relationship with the bottom panel;

a first top panel adjacent to and in foldable relationship with the back panel, the first top panel including:

a first adhesive strip to sealingly close the paperboard container into a first closed configuration;

a first tear-away strip to open the paperboard container from the first closed configuration;

a second adhesive strip to sealingly close the paperboard container into a reversed, second closed configuration; and a second top panel adjacent to and in foldable relationship with the front panel, the second top panel including a second tear-away strip to open the paperboard container from the reversed, second closed configuration.

2. The reversible paperboard container of claim 1, further comprising: the paper board material being formed of a corrugated material having two generally planar surfaces with a corrugated section secured between the two surfaces, the corrugated material being cut and scored to define the various panels and features of the container to facilitate folding of the container in a manner to provide reversible use of the container.

3. The reversible paperboard container as in claim 1, further comprising: the first adhesive strip having a peel away adhesive backing to expose adhesive material and to protect the adhesive material before use, the second adhesive strip having a peel away backing to protect the adhesive material prior to use.

4. The reversible paperboard container of claim 1 further comprising: a compatible first receiving adhesive strip appropriately positioned on a surface of the container for engagement with the first adhesive strip and a corresponding second receiving adhesive strip positioned relative to and for engagement with the second adhesive strip, the first adhesive strip, second adhesive strip and a corresponding receiving adhesive strips not requiring coverage as the strips are inert with regard to other surfaces but formed of a material to provide compatible adhesive engagement when contacting each other, the first adhesive strip bonding with the corresponding first receiving strip when engaged therewith in a first configuration and the second adhesive strip bonding with the corresponding second receiving adhesive strip in a reversed second configuration.

5. The reversible paperboard container of claim 1, comprising: at least one of the first tear-away strip and the second tear-away strip being formed in the container material of two generally linear, parallel series of perforations which provide a weakened area of material and which generally form a tear away strip for removal and separation of two adjoining portions of the corresponding panel.

6. A reversible paperboard container of claim 5 further comprising: cuts provided in the material generally proximate to and as a continuation of the perforations to form a pull able tab to help initiate the removal of the tear able strip corresponding to the panel.

7. A reversible paperboard container, comprising:

a bottom panel;

a front panel adjacent to and in foldable relationship with the bottom panel;

a back panel adjacent to and in foldable relationship with the bottom panel;

a left side panel adjacent to and in foldable relationship with the bottom panel;

a right side panel adjacent to and in foldable relationship with the bottom panel;

a first top panel adjacent to and in foldable relationship with the back panel, the first top panel including:

a first visual marking indicating the location of first adhesive strip to sealingly close the paperboard container into a first closed configuration;

a first tear-away strip to open the paperboard container from the first closed configuration;

a second visual marking indicating the location of a second adhesive strip to sealingly close the paperboard container into a reversed, second closed configuration; and a second top panel adjacent to and in foldable relationship with the front panel, the second top panel including a second tear-away strip to open the paperboard container from the reversed, second closed configuration.

8. The reversible paperboard container of claim 7, further comprising: the paper board material being formed of a corrugated material having two generally planar surfaces with a corrugated section secured between the two surfaces, the corrugated material being cut and scored to define the various panels and features of the container to facilitate folding of the container in a manner to provide reversible use of the container.

9. The reversible paperboard container as in claim 7, further comprising: the first adhesive strip having a peel away adhesive backing to expose adhesive material and to protect the adhesive material before use, the second adhesive strip having a peel away backing to protect the adhesive material prior to use.

10. The reversible paperboard container of claim 7, further comprising: a compatible first receiving adhesive strip appropriately positioned on a surface of the container for engagement with the first adhesive strip and a corresponding second receiving adhesive strip positioned relative to and for engagement with the second adhesive strip, the first adhesive strip, second adhesive strip and a corresponding receiving adhesive strips not requiring coverage as the strips are inert with regard to other surfaces but formed of a material to provide compatible adhesive engagement when contacting each other, the first adhesive strip bonding with the corresponding first receiving strip when engaged therewith in a first configuration and the second adhesive strip bonding with the corresponding second receiving adhesive strip in a reversed second configuration.

11. The reversible paperboard container of claim 7, comprising: at least one of the first tear-away strip and the second tear-away strip being formed in the container material of two generally linear, parallel series of perforations which provide a weakened area of material and which generally form a tear away strip for removal and separation of two adjoining portions of the corresponding panel.

12. A reversible paperboard container of claim 11, further comprising: cuts provided in the material generally proximate to and as a continuation of the perforations to form a pull able tab to help initiate the removal of the tear able strip corresponding to the panel.

13. A reversible paperboard container, comprising:

a bottom panel;

a front panel adjacent to and in foldable relationship with the bottom panel;

a back panel adjacent to and in foldable relationship with the bottom panel;

a left side panel adjacent to and in foldable relationship with the bottom panel;

a right side panel adjacent to and in foldable relationship with the bottom panel;

a first top panel adjacent to and in foldable relationship with the back panel, the first top panel including:

a first adhesive strip to sealingly close the paperboard container into a first closed configuration;

a first tear-away strip to open the paperboard container from the first closed configuration;

a visual marking indicating the location of a second adhesive strip to sealingly close the paperboard container into a reversed, second closed configuration; and a second top panel adjacent to and in foldable relationship with the front panel, the second top panel including a second tear-away strip to open the paperboard container from the reversed, second closed configuration.

14. The reversible paperboard container of claim 13, further comprising: the paper board material being formed of a corrugated material having two generally planar surfaces with a corrugated section secured between the two surfaces, the corrugated material being cut and scored to define the various panels and features of the container to facilitate folding of the container in a manner to provide reversible use of the container.

15. The reversible paperboard container as in claim 13, further comprising: the first adhesive strip having a peel away adhesive backing to expose adhesive material and to protect the adhesive material before use, the second adhesive strip having a peel away backing to protect the adhesive material prior to use.

16. The reversible paperboard container of claim 13, further comprising: a compatible adhesive strip appropriately positioned on a surface of the container for engagement with the first adhesive strip and a corresponding adhesive strip positioned relative to and for engagement with the second adhesive strip, the first adhesive strip, second adhesive strip and a corresponding receiving adhesive strips no requiring coverage as the strips are inert with regard to other surfaces but formed of a material to provide compatible adhesive engagement when contacting each other, the first adhesive strip bonding with the corresponding receiving strip when engaged therewith in a first configuration and the second adhesive strip bonding with the corresponding receiving adhesive strip in a reversed second configuration.

17. The reversible paperboard container of claim 13, comprising: at least one of the first tear-away strip and the second tear-away strip being formed in the container material of two generally linear, parallel series of perforations which provide a weakened area of material and which generally form a tear away strip for removal and separation of two adjoining portions of the corresponding panel.

18. A reversible paperboard container of claim 17, further comprising: cuts provided in the material generally proximate to and as a continuation of the perforations to form a pull able tab to help initiate the removal of the tear able strip corresponding to the panel.

* * * * *